United States Patent [19]

Weaver

[11] Patent Number: 4,673,125

[45] Date of Patent: Jun. 16, 1987

[54] DISPENSING CONTAINER

[75] Inventor: Douglas L. Weaver, Middlesex, N.J.

[73] Assignee: Container Corporation of America, Chicago, Ill.

[21] Appl. No.: 877,172

[22] Filed: Jun. 23, 1986

[51] Int. Cl.[4] ..... B65D 5/50

[52] U.S. Cl. ..... 229/17 B; 206/620; 220/403; 222/105; 222/541; 222/564

[58] Field of Search ..... 229/17 B, 7 R; 222/105, 222/185, 541, 547, 564; 206/620, 586; 220/403, 461, 462

[56] References Cited

U.S. PATENT DOCUMENTS

| | | | |
|---|---|---|---|
| 2,171,415 | 8/1939 | Haney | 229/17 B |
| 2,954,901 | 10/1960 | Winstead | 229/7 R |
| 3,081,003 | 3/1963 | Baxter et al. | 222/541 |
| 3,112,047 | 11/1963 | Weinreich et al. | 222/105 |
| 3,191,810 | 6/1965 | Johnston | 222/185 |
| 3,221,943 | 12/1965 | Anderson | 222/541 |
| 3,701,466 | 10/1972 | Woodrow et al. | 229/17 B |
| 4,039,118 | 8/1977 | Kawaoka | 229/17 B |
| 4,120,420 | 10/1978 | Dirksing | 229/17 B |
| 4,342,405 | 8/1982 | Croley | 222/564 |
| 4,548,351 | 10/1985 | Gusic | 229/17 B |

FOREIGN PATENT DOCUMENTS

| | | | |
|---|---|---|---|
| 2163741 | 3/1973 | German Democratic Rep. | 222/564 |

*Primary Examiner*—William Price
*Assistant Examiner*—Gary E. Elkins
*Attorney, Agent, or Firm*—Richard W. Carpenter

[57] ABSTRACT

An outer container for use with an inner flexible bag in a composite package for holding and dispensing liquids, the container being formed from a unitary blank of foldable paperboard and having a dispensing opening in the bottom wall and having a sloping platform positioned on the bottom wall adjacent the opening to facilitate emptying of the bag held within the container.

2 Claims, 4 Drawing Figures

DISPENSING CONTAINER

BACKGROUND OF THE INVENTION

1. Field of the Invention

This invention relates to dispensing containers, and more particularly to an outer container formed of paperboard for use with an inner flexible bag in a composite package designed to hold and dispense liquids.

2. Description of the Prior Art

A prior art search directed to the subject matter of this application in the U.S. Patent and Trademark Office disclosed the following U.S. Pat. Nos.: 3,568,911; 3,536,247; 3,450,308; 2,785,843; 2,568,725; 1,889,232; 1,378,534.

None of the prior art patents uncovered in the search discloses a container for a composite package adapted to hold a bag and having a dispensing tab in the bottom wall with a sloping platform on the bottom wall adapted to assist in the dispensing of liquid material from the bag by directing it downwardly toward the dispensing opening in the bottom of the outer container.

SUMMARY OF THE INVENTION

It is an object of the present invention to provide a paperboard outer container for a composite package consisting of a container and inner flexible bag adapted to hold liquid material.

A more specific object of the invention is the provision of an outer container for a composite package which has a dispensing opening in the bottom wall and an inner platform on the bottom wall with a sloping surface to facilitate emptying of the contents of an inner bag.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
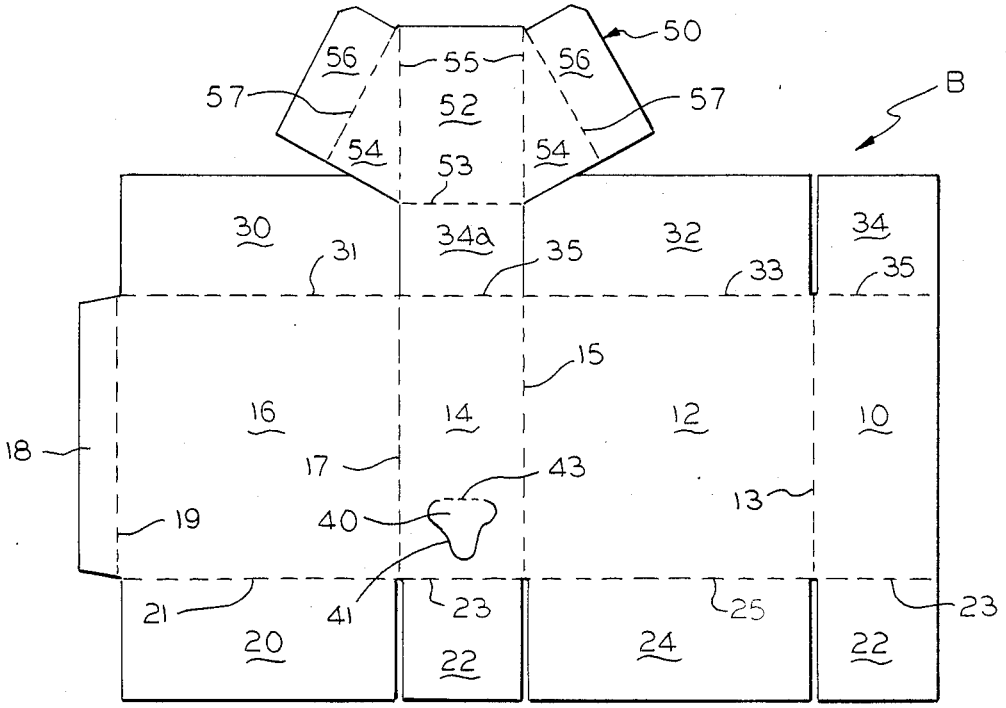
FIG. 1 is a plan view of a blank of foldable sheet material from which the container illustrated in other views may be formed.

Referring now to the drawings for a better understanding of the invention, and particularly to FIG. 1, it will be seen that there is illustrated a composite package, indiated generally at P, which includes an inner, flexible, liquid-holding bag B and an outer shipping container X which embodies features of the present invention.

The container X is a six-sided, box-like structure which may be formed from the unitary blank B of foldable sheet material illustrated in FIG. 1 of the drawings.

Turning now to FIG. 1, will be seen that the main portion or body of the container includes a top wall panel 10, a first side wall panel 12, a bottom wall panel 14, a second side wall panel 16, and glue panel or flap 18, which are foldably joined to each other along parallel fold lines 13, 15, 17, and 19, respectively.

The front and rear end walls of the container are formed from overlapping panels or flaps secured to the main panels.

The front end wall includes an outer panel 20, foldably joined to an end edge of second side wall panel 16 along a fold line 21, a pair of intermediate panels 22 foldably joined along fold lines 23 to corresponding end edges of top and bottom wall panels 10 and 14, respectively, and an inner panel 24, foldably joined along a fold line 25 to a related end edge of first side wall panel 12.

The rear wall of the container is of somewhat similar construction, but the arrangement of the panels is slightly different.

In the case of the rear wall there is an outer panel 30 foldably joined along a fold line 31 to a rear edge of second side wall panel 16, an intermediate panel 32 foldably joined along a fold line 33 to a related end edge of first side wall panel 12, and a pair of inner panels 34 and **34*a* which are foldably joined along fold lines 35 to related end edges of top and bottom wall panels 10 and 14**, respectively.

Figure 2:
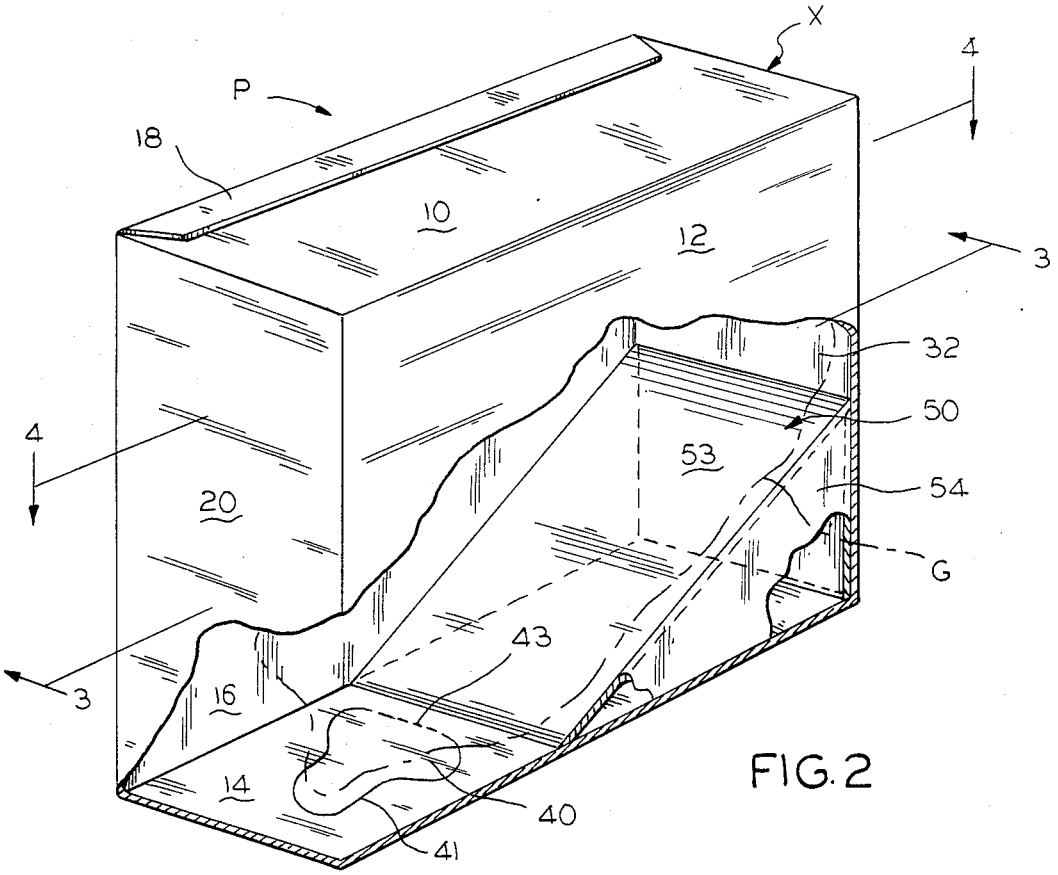
FIG. 2 is a perspective view, with portions of the structure broken away, of a composite package which includes a container embodying features of the present invention.
Figure 3:
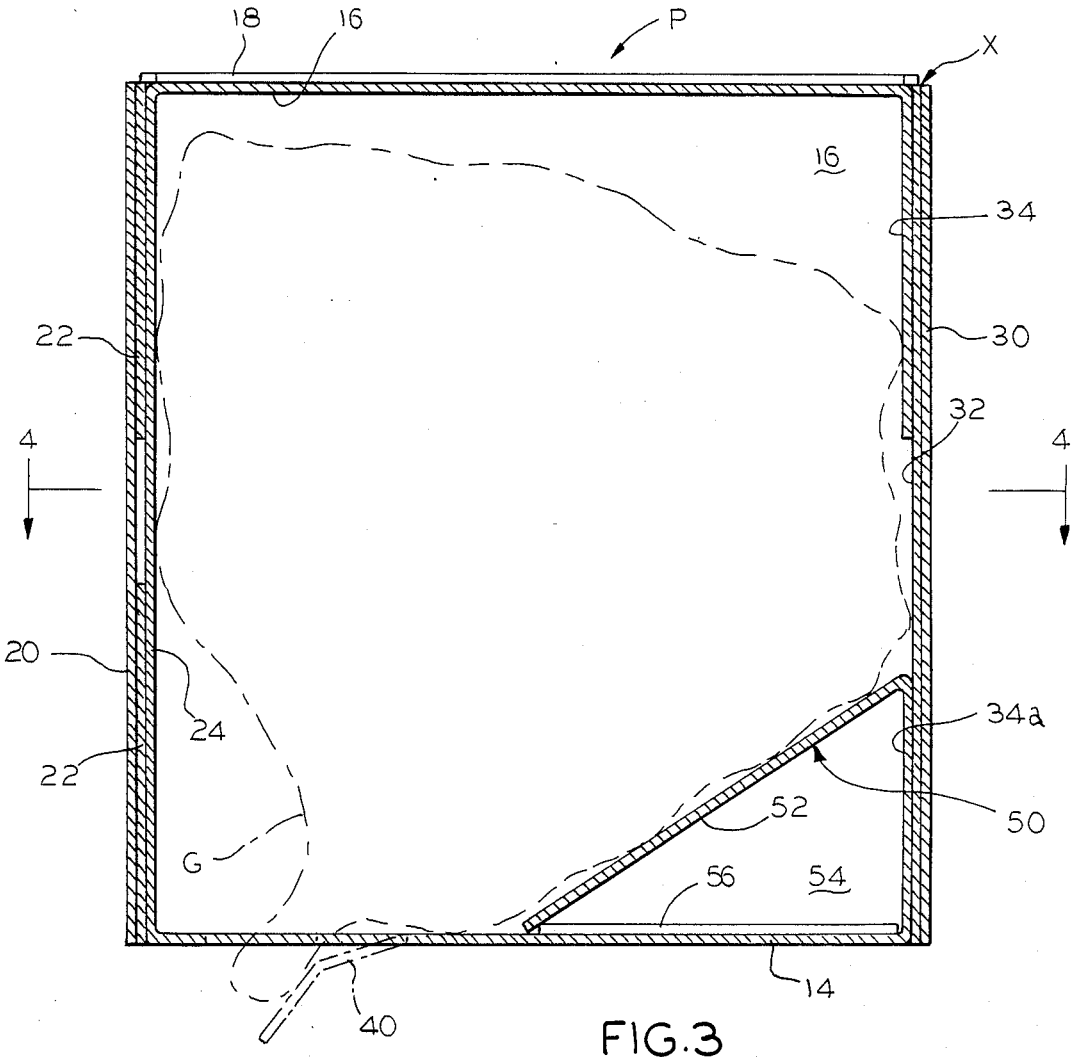
FIG. 3 is a fragmentary, vertical, sectional view taken on line 3—3 of FIG. 2.
Figure 4:
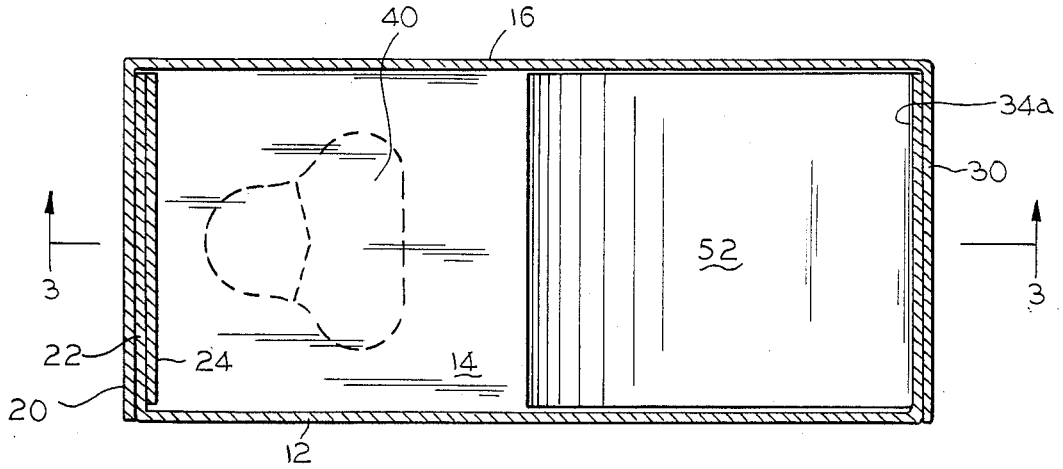
FIG. 4 is a fragmentary, horizontal, sectional view taken on line 4—4 of FIG. 2.

Still referring to FIGS. 1 and 2 it will be seen that bottom wall panel 14 is provided with an integral dispensing tab indicated generally at 40 which is defined in part by a contoured cut line 41 and in part by a fold line 43. The purpose of the tab is to afford access to the interior container and to permit a portion of the bag to be pulled through, so that liquid material can be dispensed from the container through the bottom wall thereof. It is contemplated that the container would be used in connection with a dispensing mechansim of some type which requires the container to be kept in a level or non-sloping position and with the material being dispensed through the bottom wall of the container.

In order to facilitate the emptying of an inner bag positioned within the container, there is provided an integral platform indicated generally at 50.

Platform 50 includes an upper or deck panel 52 which is foldably joined at its rear edge to the upper edge of rear wall inner panel **43*a* along a fold line 53**.

The platform also includes a pair of generally triangular shaped side panels 54 which are foldably joined on fold lines 55 to opposite side edges of deck panel 52. The platform also includes a pair of bottom or anchor panels 56 which are foldably joined along fold lines 57 to corresponding lower edges of side panels 54.

As best seen in FIG. 2, when the container is erected, the deck panel 52 is disposed to slope forwardly and downwardly from the upper edge of rear wall inner panel **34*a* and toward the dispensing tab 40. The side panels 54 are folded downwardly from the deck panel 52 and lie inside and adjacent the inner surfaces of the container side walls 12 and 16. At the same time the anchor or bottom panels 56 are folded inwardly at right angles from the side panels 54 so as to lie on the upper inner surface of container bottom wall panel 14** and maintain the platform in a snug, secure position.

Thus, it will be appreciated that when it is desired to dispense liquid from a bag maintained within the container, the dispensing tab 40 is pulled down and a spout or dispensing tube portion of the bag is pulled out of the container through the dispensing opening created by the removal or partial removal of the dispensing tab.

The purpose of the platform 50 is to insure that the liquid in the material will be emptied thereform and drained as completely as possible.

What is claimed is:

1. A blank of foldable sheet material, such as paperboard, adapted to form an outer container for use with in inner flexible bag in a composite package for holding and dispensing liquids, said blank being cut and scored to provide:

(a) a central body portion including a top wall panel, a first side wall panel, a bottom wall panel, a second side wall panel, and a glue panel foldable joined to each other along parallel fold lines;

(b) end wall forming panels foldably joined to opposite ends of said top, bottom, and side wall panels;

(c) said bottom wall panel including an integral dispensing tab formed from material thereof and detachably secured thereto adjacent one end thereof;

(d) a platform forming section located, at an opposite end of said bottom wall panel from said dispensing tab, and comprising:

(i) a deck panel foldably joined at one end to an outboard end of the end wall forming panel joined to said bottom wall panel;

(ii) a pair of generally triangularly shaped side panels foldably joined to opposite side edges of said deck panel;

(iii) a pair of generally rectangular anchor panels foldably joined to corresponding outer edges of respective side panels.

2. An outer container for use with an inner flexible bag in a composite package for holding and dispensing liquids, said container being formed from a unitary blank of foldable sheet material, such as paperboard, and comprising:

(a) pairs of opposed top and bottom, front and rear, and left and right side walls foldably joined to each other to form a hexahedral structural;

(b) said bottom wall including an integral, partially detachable, dispensing tab cut from material thereof and defined by a weakened line of tear and a fold line;

(c) said container including an integral, wedge shaped platform positioned on said bottom wall adjacent said rear wall and presenting a relatively flat, upper surface which slopes forwardly and downwardly toward said dispensing tab;

(d) said platform including:

(i) a generally rectangular deck panel sloping downwardly and forwardly from said rear wall to said bottom wall;

(ii) a pair of generally triangular side panels foldably joined to opposite side edges of said deck panel and extending downwardly therefrom to said bottom wall adjacent respective container side walls;

(iii) a pair of generally rectangular anchor panels foldably joined to lower edges of respective platform side panels and being folded to extend inwardly therefrom toward each other and to overlie said bottom wall.

* * * * *